United States Patent [19]

Bauer

[11] 4,078,725

[45] Mar. 14, 1978

[54] SPRAY APPARATUS

[76] Inventor: Peter Bauer, 13921 Esworthy Rd., Germantown, Md. 20767

[21] Appl. No.: 702,627

[22] Filed: Jul. 6, 1976

[51] Int. Cl.[2] ..... B05B 11/00

[52] U.S. Cl. ..... 239/7; 118/DIG. 16; 222/406; 239/220; 239/222; 239/329; 239/373

[58] Field of Search ..... 239/7, 11, 222, 329, 239/337, 373, 219, 220; 118/DIG. 16; 222/406, 401, 400.7, 400.8

[56] References Cited

U.S. PATENT DOCUMENTS

| | | | |
|---|---|---|---|
| 51,891 | 1/1866 | Campbell | 118/DIG. 16 |
| 506,389 | 10/1893 | Claus | 239/7 |
| 3,648,652 | 3/1972 | Katzman et al. | 118/DIG. 16 |
| 3,667,654 | 6/1972 | Holley | 118/DIG. 16 X |

FOREIGN PATENT DOCUMENTS

| | | | |
|---|---|---|---|
| 1,027,150 | 5/1953 | France | 239/220 |
| 1,026,252 | 3/1958 | Germany | 118/300 |

*Primary Examiner*—Evon C. Blunk
*Assistant Examiner*—Michael Mar
*Attorney, Agent, or Firm*—Rose & Edell

[57] ABSTRACT

A hand-operated liquid spray apparatus operates on the air-lift pump principle wherein the air-forcing member and the spray-forming member are one and the same. Such an apparatus requires no nozzles or valves and no permanent pressurization of the sprayed liquid. A plurality of deflectable vanes are movably disposed in an open-ended chamber which communicates with the interior of a liquid container via separate air and liquid passages. The vanes, when at rest, seal both passages from the open chamber end. Operator-initiated motion of the vanes toward the air passage forces air trapped in the chamber through the air passage and into the container, thereby forcing liquid up through the liquid passage to wet the vanes in the chamber. A lip at the open end of the chamber is arranged to deflect the wetted vanes as they move past the lip. After passing the lip the deflected vanes spring back to their undeflected positions and, in so doing, throw off a spray pattern of liquid droplets. The embodiments having rectilinear and rotational strokes.

19 Claims, 10 Drawing Figures

FIG.1
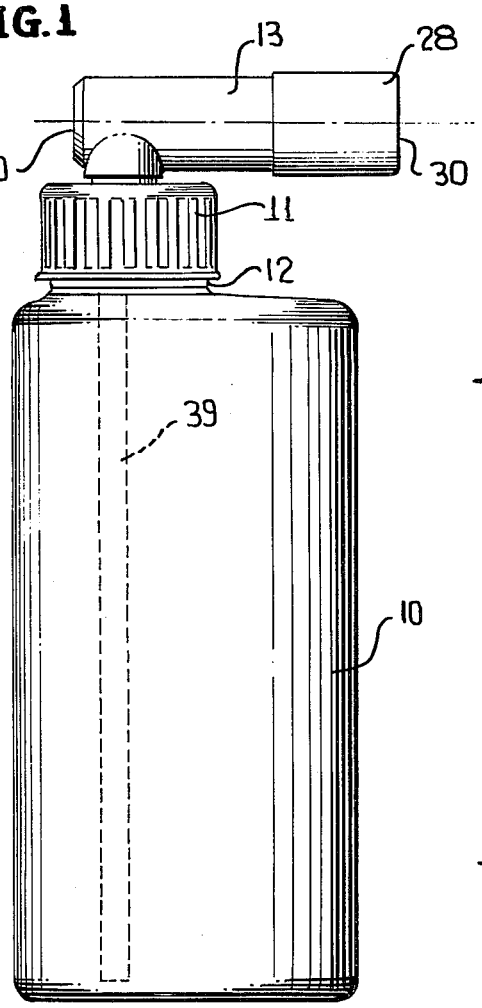
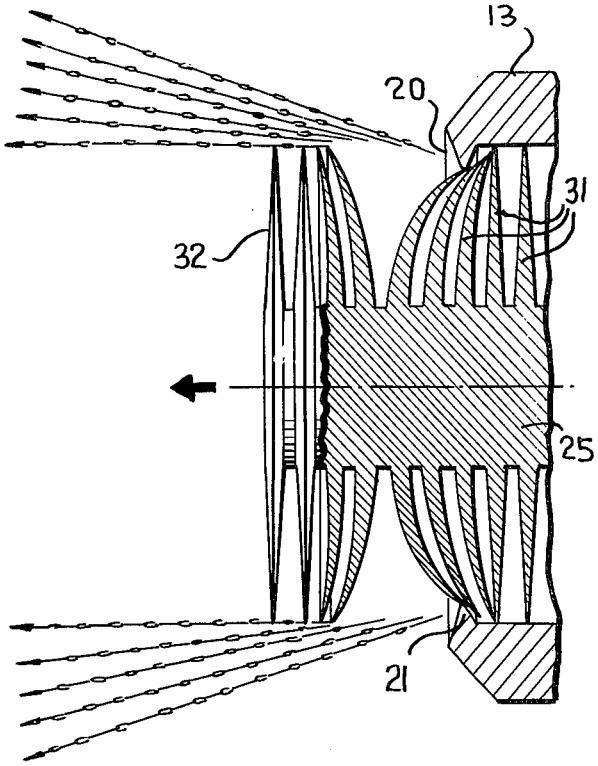
FIG.5
FIG.2
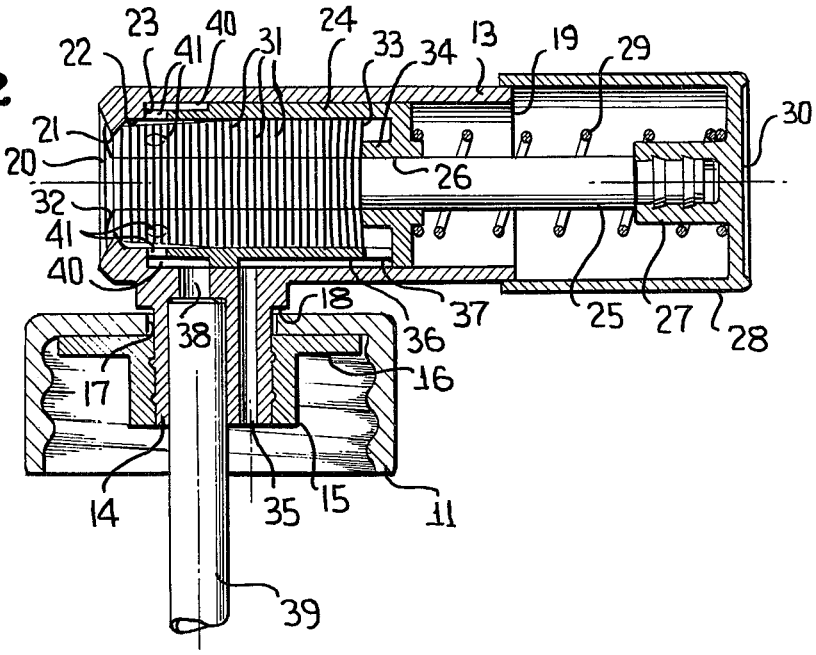

FIG.3
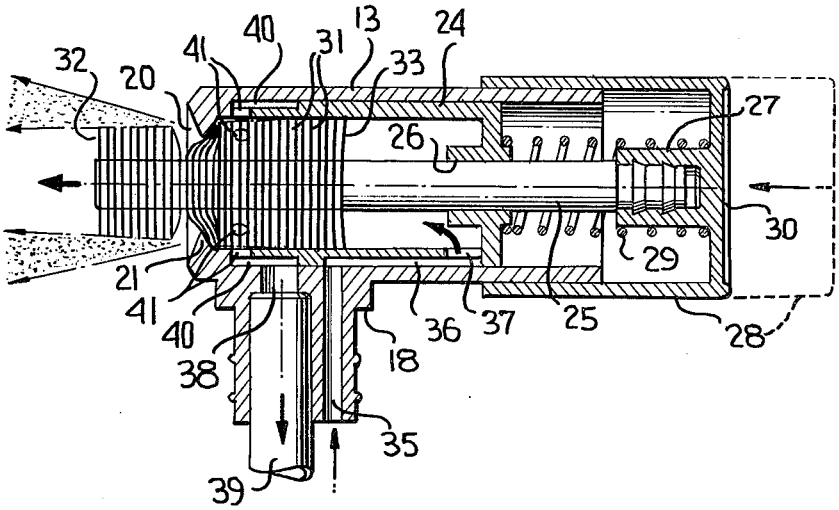
FIG.4
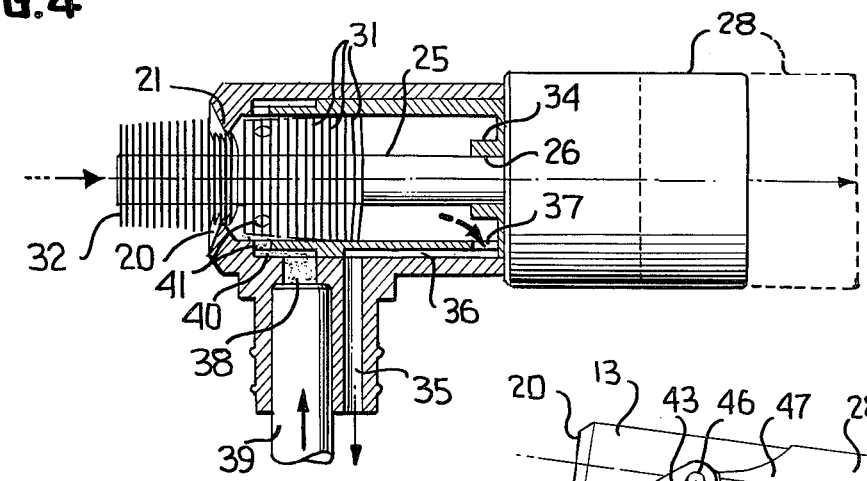
FIG.6
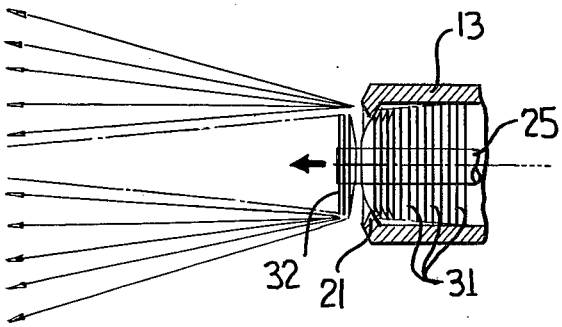
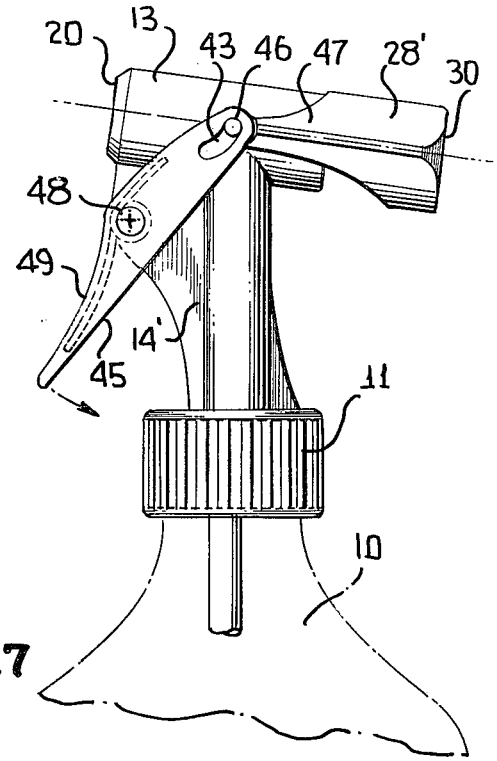
FIG.7

FIG.8
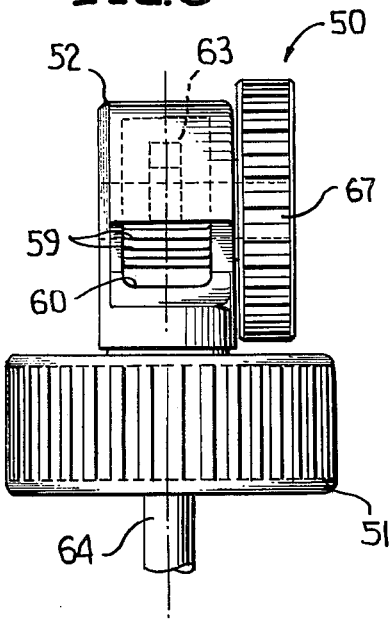
FIG.9
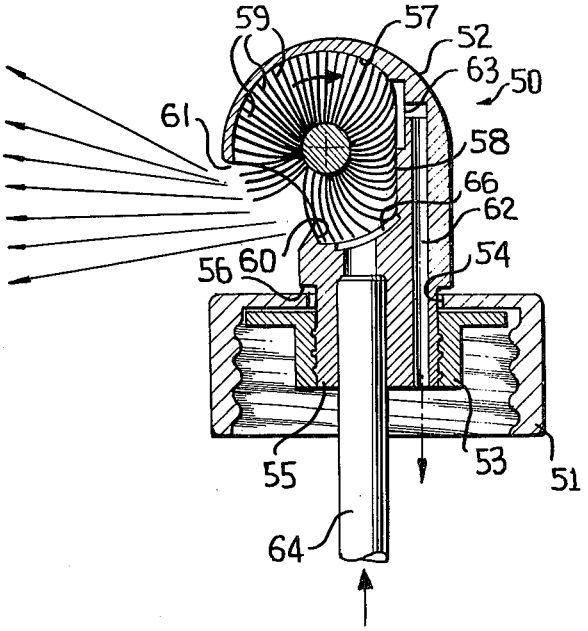
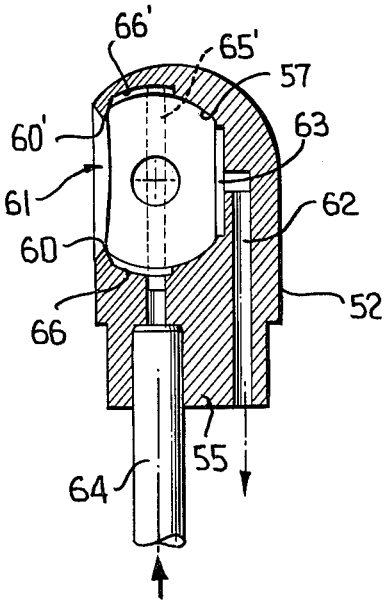
FIG.10

SPRAY APPARATUS

BACKGROUND OF THE INVENTION

The present invention relates to an improved apparatus and method for spraying liquid in a manner which eliminates the need for nozzles, valves, and pressurized containers.

With the discovery that common aerosol sprays pollute the atmosphere and produce droplet sizes that can be harmful if inhaled, there has been considerable research activity directed toward the development of new spray apparatus. Since the spray apparatus must often be the throw-away kind, cost considerations weigh heavily on the approaches worth exploring. Other important considerations are: the need to seal the spray apparatus to avoid spillage should the container be upset; the need to prevent clogging by certain types of sprayed liquids which tend to coagulate; simplicity and ease of operation; low pressure requirements for spray pattern formation; and operability in any orientation of the container.

It is an object of the present invention to provide a unique spray apparatus and method which optimizes all of the foregoing considerations. More particularly, it is an object of the present invention to provide a method and apparatus for spraying liquid wherein: cost of the apparatus is extremely low; clogging of the apparatus is eliminated; a uniform spray pattern is produced without the fine droplets that can be health hazards; polluting aerosol propellants are not required; the liquid need not be kept under pressure; operation is effected with a simple movement of the finger or hand; and the spray apparatus provides an efficient seal to prevent spillage.

SUMMARY OF THE INVENTION

In accordance with one embodiment of the present invention, a plurality of deflectable annular vanes are centered on an actuating rod and disposed within a cylinder having an open end. The open cylinder end has an annular lip of smaller diameter than the vanes so that the vanes are deflected when forced past the lip and so that the forward vane (i.e. closest to the lip) can seal the open cylinder end. An air passage communicates between the top of a container of liquid and the closed cylinder end. The rearward vane (i.e. closest to the closed cylinder end) has a slightly larger diameter than the cylinder so that the cylinder volume at the rearward end of the cylinder is sealed off from the volume forward of that vane. A liquid passage from the liquid container communicates with the cylinder proximate its forward end. When the actuation rod, which is normally biased in its rearmost position, is moved forward, the rearward vane moves forward to expand the volume behind it, thereby drawing air up the air passage into that volume. At the same time, the vanes are pushed through the open cylinder end and are deflected by the lip. After passing the lip the deflected vanes snap back to their normal position and, in so doing, throw off any liquid with which they are wetted in a well-defined spray pattern of fairly uniform droplet size. When the actuation rod is released it carries the vanes back into the cylinder whereupon the rearward vane forces the air in the reducing volume back down the air passage. The forced air acts on the surface of the liquid in the container to force the liquid up through the liquid passage and into the cylinder where it wets the vanes to prepare for the next stroke of the rod.

Various actuating mechanisms and vane configurations are possible, depending upon the spray requirements. In addition, the principle may be applied to a rotational stroke in which case the vanes are shaped like paddle wheels which rotate about an axis in a cylinder having a longitudinally-extending opening at one side.

BRIEF DESCRIPTION OF THE DRAWINGS

The above and still further objects, features and advantages of the present invention will become apparent upon consideration of the following detailed description of one specific embodiment thereof, especially when taken in conjunction with the accompanying drawings, wherein:

FIG. 1 is a side view in plan view of one sprayer embodiment of the present invention secured at the top of a container of liquid;

FIG. 2 is a detail view section of the sprayer embodiment of FIG. 1;

FIG. 3 is a view similar to FIG. 2 which diagrammatically illustrates sprayer operation during the forward portion of the actuation cycle;

FIG. 4 is a view similar to FIG. 2 which diagrammatically illustrates sprayer operation during the rearward portion of the actuation cycle;

FIG. 5 is a diagrammatic illustration of how the spray pattern is formed in the embodiment of FIG. 1;

FIG. 6 is a view similar to FIG. 5 but illustrating the effect on the spray pattern when the vane sizes are tapered;

FIG. 7 is a side view in plan of a modified version of the embodiment of FIG. 1 adapted to be operated by a trigger mechanism;

FIG. 8 is a front view in plan of another embodiment of the present invention;

FIG. 9 is a side view in section of the embodiment of FIG. 8; and

FIG. 10 is a side view in section of a modification of the embodiment of FIG. 8.

DESCRIPTION OF PREFERRED EMBODIMENTS

Referring specifically to FIGS. 1 and 2 of the accompanying drawings, a container 10 of liquid to be sprayed has a cap 11 threadedly engaging a neck portion 12 at the top of the container. A cylinder 13 includes a depending stem portion 14 of generally cylindrical configuration which projects downwardly through a suitably provided hole or opening 17 at the top of cap 11. A gasket 15 includes a hollow cylindrical section which is press-fitted onto stem 14 inside the cap 11. The upper portion of gasket 15 is in the form of a flange 16 which abuts the underside of the top of cap 11 to prevent upward movement of the stem through the hole in cap 11. A shoulder 18 is formed in stem 14, just above the cap 11 to preclude downward movement of the stem beyond the shoulder. Flange 16 and shoulder 18 thus combine to prevent movement of the stem 14 relative to cap 11.

The cylinder 13 is oriented with its longitudinal axis extending perpendicular to stem 14, or horizontally as illustrated in FIGS. 1 and 2. Cylinder 13 is hollow and open at both its back end 19 and forward end 20. A sharp-edged annular lip 21 projects radially inward of the cylinder at forward end 20 to render the area of the opening at that end somewhat smaller than the cross-sectional area anywhere else in cylinder 13. The short cylinder section 22 immediately rearward of lip 21 has a somewhat larger interior cross-sectional area that at lip 21 but somewhat smaller than the remainder of the cylinder interior, there being a shoulder 23 defining the transition between section 22 and the remainder of the cylinder. A cup-like sleeve 24 is press-fitted inside cylinder 13 with the open end or rim of the sleeve abutting shoulder 23. The opposite or "closed" end of cup-like sleeve 24 is provided with a central opening through which an actuator rod 25 extends in longitudinally slidable relation. A suitable annular bearing surface 26 is provided in this cup opening to facilitate sliding motion of the rod 25 relative to the sleeve.

The actuator rod 25 is considerably longer than cylinder 13 and has its rearward end engaged in a snap-fit relationship by a receiver portion 27 of a cup-shaped pusher member 28. The open end of pusher member 28 fits over the outer surface of cylinder 13 in telescopic relation to permit the pusher member to be pushed forward to receive a greater length of cylinder 13 therein. A helical spring 29 surrounds the portion of the actuator rod 25 which extends rearwardly of sleeve 24 and is positioned to bias pusher member 28 away from sleeve 24. In other words, spring 29 biases the cylinder 13 and pusher 28 to their extended position wherein a minimal portion of cylinder 13 resides in the pusher member. It should be noted that the outer rear surface 30 of pusher member 28 is located so that the thumb of an individual can readily push the pusher member 28 forward against the action of spring 29 when the bottle 10 is grasped in the palm of the individual.

The section of actuator rod 25 residing inside sleeve 24 has multiple closely-spaced annular vanes 31 projecting radially therefrom. With the exception of the rearwardmost vane 33, the only limitation on the diameter of vanes 31 is that they be greater than that of lip 21 and sufficiently small to fit within sleeve 24. Rearwardmost vane 33 must be sufficiently large to seal off the space rearward of that vane from the space forward thereof. In the fully extended or rest position of the device (i.e. with pusher member 28 biased to its extreme position by the spring 29), an annular projection 34 from the rear wall of sleeve 24 abuts the rearwardmost vane 33 to serve as a stop. The forwardmost vane 32, in the illustrated embodiment, remains forward of and in abutting relation with lip 21 in the rest position of the device to serve as a seal at forward end 20 of cylinder 13.

The vanes are sufficiently flexible to be deflected by lip 21 when the actuator rod 25 and vanes 33 are pushed out through cylinder end 20 by pusher member 28 against the bias force of spring 29. It is this flexibility which also permits forward vane 32 to flex slightly in the rest position of the device so as to provide a resilient seal at lip 21. For reasons to be described subsequently, the vane sizes taper from larger to smaller in a forward direction along at least the forwardmost group of vanes.

A relatively small diameter bore 35 is defined through the entire length of stem 14. Bore 35 in turn communicates with an arcuate slot 36 defined along the outer wall of sleeve 24 and extending rearward of the intersection with bore 35. A hole 37 is defined through the wall of sleeve 24 at the rearward end of slot 36. Thus, bore 35, slot 36 and hole 37 combine to serve as an air passage between the interior of container 10 and the space in sleeve 24 rearward of rearward vane 33.

A second bore 38 also extends down along the entire length of stem 14 at a location somewhat forward of bore 35. The lower portion of bore 38 is relatively large and is adapted to receive a dip tube 39 in press-fit engagement. The dip tube extends down into liquid container 10, typically to the bottom thereof. The upper portion of the bore 38 communicates with an annular slot 40 defined in the outer wall of sleeve 24 and the inner wall of cylinder 13 at the forward end of the sleeve. A plurality of spaced holes 41 are defined around the forward end of sleeve 24 to provide flow communication between annular slot 40 and the interior of sleeve 24. Thus dip tube 39, bore 38, slot 40 and holes 41 define a liquid passage from the container interior to the sleeve interior.

Operation of the spray apparatus of FIGS. 1 and 2 is best illustrated in FIGS. 3 and 4. Assuming that there is no liquid inside sleeve 24 or on any of the vanes 31, the initial forward stroke of the pusher member 28 does not result in spray being issued. However, as rear vane 33 moves forward (see FIG. 3) it evacuates the space behind it in sleeve 24 causing air to be drawn up air passage 35, 36, 37 from the top of container 10. The reduced pressure in the container, combined with the forward-directed forcing action of the rear vanes, tends to deliver some air down through the dip tube 39 via holes 41, slot 40 and bore 38. This delivered air will normally bubble up to the surface of the liquid in the container.

Upon release of the pusher member 28 (see FIG. 4) spring 29 forces the pusher member rearward until rear vane 33 is stopped by projection 34. The rearward motion of vane 33 compresses the air between that vane and the rear of sleeve 24, thereby forcing the air down through air passage 37, 36, 35 into container 10. This air exerts a pressure on the surface of the liquid in container 10 to force the liquid up through the dip tube 39 and bore 38 and into the sleeve 24 via slot 40 and holes 41. This liquid wets the vanes as they return to the sleeve interior toward their rest positions. On the next forward stroke the wetted vanes throw off a spray of the wetting liquid as the vanes snap back to their undeflected positions after being deflected while passing lip 21. This spraying action is best illustrated in FIG. 5. Specifically, as the actuator rod 25 is pushed forward, each vane 31, in turn, is deflected backward by lip 21. After the deflected vane 31 clears lip 21 it snaps forward, overshooting its unflexed position and then finally returning to the unflexed position in a highly damped oscillatory motion. The initial forward snap creates the combined action of: a centrifugal force on the liquid to throw it radially outward from rod 25 toward the outer edge of the vane; and a forward-directed flicking action which throws the liquid generally forwardly from the vane edge, whereupon it breaks up into droplets in a relatively narrow range of droplet sizes. The spray pattern is generally conical, widening in a downstream direction, with each successively deflected vane supplying a successively outer layer of the conical pattern. If the vanes are all the same size, as illustrated in FIG. 5, the interior of the spray pattern is hollow; that is, the central core of the pattern contains no droplets. If, however, the vanes are tapered so that the forward vanes are of smaller diameter than those immediately behind them, as illustrated in FIG. 6, the central core of the spray pattern is filled slightly downstream of end 20 of the cylinder 13. This results because the droplets flicked off by each vane, during the overshoot segment of its snap back motion, are not blocked by the outer edge of the immediately forward vane. It is during this overshoot motion that the vanes tend to throw the liquid inward whereupon the droplets fill the core of the spray pattern.

In view of this effect of tapering of the vane sizes on spray pattern configuration, it is evident that considerable pattern variation can be achieved by varying both the sizes and the configurations of the vanes. The sealing function of the forward vane 32 and rear vane 33 must, of course, not be lost. However, the intermediate vanes may be shaped as cloverleafs, semi-circles, circle segments, etc. In addition, the intermediate vanes may be formed as a continuous helix. The vanes may be in the form of lobes which all reside on the same side of the actuator rod, or they may be angularly displaced as desired. To reiterate, the key is the desired spray pattern configuration; the vane configurations can be shaped accordingly.

It will be recognized, of course, that rear vane 33 must be disposed on actuator rod 25 in such a position that it does not leave cylinder 13 during the forward stroke.

Materials suitable for the various components of the sprayer must merely be compatible with the operation described. In many cases the material will depend upon the liqud to be sprayed since certain liquids adversely affect some materials which might adequately serve for other liquids. For most common household sprays the vanes may be injection-molded polypropylene, a material which has the desired semi-elastic properties required of the vanes and is immune to most solvents. The relatively stiff elastomers and rubber components are also suitable. In some cases metal such as beryllium copper or other spring metal may be required.

In the illustrated embodiments the vanes are shown as being thicker at their base (i.e. near the rod 25) than at their edge. This is highly advantageous for injection molded plastics but this narrowing configuration is by no means a functional requirement for the sprayer. It is desirable, although not necessarily crucial, that the spacing between the vanes be sufficiently small to permit liquid in sleeve 24 to fill that spacing by means of capillary action. This facilitates random distribution of the liquid around the vane surfaces and tends to produce a more evenly distributed spray pattern. For example, if the vane thickness is approximately 0.010 inch, gaps between the vanes should be approximately the same, namely 0.010 inch.

It should also be noted that some liquids may tend to adhere to the vanes, in which case a greater flexure angle may be required to positively flick the liquid off the vane. Greater flexure angle may be achieved by closing lip 21 down more and/or by tapering the thickness of the vanes to a greater extent.

The simple thumb-actuated arrangement described above can be modified, as illustrated in FIG. 7, to be trigger-actuable. The modification includes elongation of the stem 14' so that a longer portion of the stem resides between cylinder 13 and bottle cap 11. In addition the pusher member 28' is modified to include two forwardly projecting fingers 47 extending along opposite sides of cylinder 13. The forward end of each finger 47 includes a small retainer pin 46 which extends radially outward from the cylinder. A trigger member 45 includes a grip section 49 at its lower end and a bifurcated upper end which straddles stem 14. An arcuate slot 43 is defined at the upper end of each bifurcated segment of the trigger member, each slot 43 engaging a respective retainer pin 46 of pusher member 28'. The bifurcated sections of the trigger member 45 are also pivotally secured, by means of pivot pin 48 or the like, to stem 14' at a location intermediate the slots 43 and grip surface 49.

Operation of the trigger mechanism of FIG. 7 normally requires the operator to grasp stem 14' with the rearward side of the stem against the palm and with the thumb extending forwardly along one side and wrapped about the stem. The remaining fingers extend forwardly along the other side of the stem and engage the trigger surface 49. By squeezing the hand the operator pulls trigger surface 49 rearward, effecting a pivot of the trigger member 45 about pivot pin 48. The upper bifurcated part of the trigger member is pivoted forward, whereby slots 43 pull pins 46 and pusher member 28' forward to effect the forward stroke of the sprayer. The internal spring 29 (FIG. 2) returns the mechanism to its rest condition upon release of trigger member 45.

The thumb-actuated and trigger-actuated embodiments described above are intended to be representative of a variety of actuating mechanisms suitable for effecting the stroke required of the pusher mechanisms 28, 28'.

It should also be noted that the rectilinear stroke effected in the mechanism of FIGS. 1 – 7 is not a limiting factor on the present invention. It is also possible to provide a rotary motion to vanes of the type described and thereby produce a desired spray pattern. One such rotary-motion embodiment 50 is illustrated in FIGS. 8 and 9 to which reference is now made. A container or bottle cap 51 has an opening 54 through its top and through which the lower portion or stem 55 of a housing 52 projects. Stem 55 is press-fitted onto a gasket 53, much like gasket 15 of FIG. 2, which cooperates with a suitable shoulder 56 defined in the stem to secure housing 52 to cap 51.

Proximate the top of housing 52 there is defined an internal chamber 57. An actuator rod 58 is mounted horizontally for rotation within chamber 57 and includes multiple flexible or deflectable vanes extending radially therefrom about its entire circumference. Viewing chamber 57 from the side, as in FIG. 9, and considering the chamber 57 to be subdivided into imaginary quadrants for ease in description, the upper left quadrant and a continuing part of the upper right quadrant is a sector of a circle (approximately 120°) having a radius approximately equal to the distance from the center of rod 58 to the extremity of vanes 59. In the lower portion of the upper right quadrant, and continuing into the upper right portion of the lower right quadrant, chamber 57 is truncated, whereby vanes 59 in this truncated region are forced to flex. The lower part of the lower right quadrant then enlarges to form a sector of a circle (approximately 45°) of generally the same radius as in the upper left quadrant. At the lowermost part of the lower left quadrant there is a lip 60 provided with forces vanes 59 passing thereby to flex or deflect. The remainder of the lower left quadrant (virtually all of it) is open and serves as the spray opening 61 for the mechanism.

An air passage into the container of liquid is made up of a bore 62 and slot 63. Bore 62 extends through stem 55 and up through housing 52 to a location rearward of the truncated part of chamber 57 where it communicates with slot 63 defined as a recess across part of that truncated region. A liquid passage is made up of a dip tube 64, bore 65, and slot 66. Bore 65 extends down through stem 55 from a location below the sectored lower right quadrant of chamber 57. Dip tube 64 is force-fitted into bore 65 and extends to the bottom of the container of liquid. Slot 66 is defined across the sectored portion of the lower right quadrant of the chamber.

Actuator rod 58 extends out through housing 52 through the center of a circular thumbwheel 67. Rotation of thumbwheel 67 produces a like rotation of rod 58 and, therefore, rotation of vanes 59 in chamber 57. The thumbwheel 67 is positioned so as to be readily rotated clockwise (as viewed in FIG. 9) by the thumb of an operator who is holding the bottle of liquid to be sprayed (not shown) in his or her palm.

Operation of the device of FIGS. 8 and 9 is as follows: As the thumbwheel 67 rotates vanes 59 clockwise, the vanes entering up into the upper left quadrant from opening 61 seal the chamber 57 and force air trapped in front of the vanes along the clockwise path. This trapped air is forced by the vanes 59 into slot 63 and down through bore 62 as the vanes are deflected in the truncated part of the chamber. The air forced down air passage 62, 63 pressurizes the liquid in the container to force liquid up through dip tube 64, bore 65 and into the chamber 57 at slot 66 where the liquid wets vanes 59 as they pass slot 66. The wetted vanes 59 are then deflected by lip 60 and, upon clearing the lip, spring forward into opening 61 where they throw a spray pattern of droplets through that opening.

The spray pattern emanating from opening 61 uniformly covers an area determined by the size and shope of the opening. A change in the width or length of the opening, for example, or of its configuration, can produce a wide variety of spray patterns. Likewise the vanes 59, which in the form illustrated are rectangular paddles, can be varied in shape to effect desired spray pattern configurations.

The rotary embodiment illustrated in FIGS. 8 and 9 does not require a restoring spring, as does the embodiment of FIGS. 1 - 7, to return the actuator to a prescribed rest position. In other words, the sprayer of FIGS. 8 and 9 is operable from whatever position in which it may have stopped when last actuated. General considerations still apply for both embodiments, however; such as the requirement that the vanes seal the chamber interior at the spray opening and that the vanes seal the portion of the chamber containing the air passage inlet (63 or 37) so that the air pump effect may be retained. Type of material and other similar considerations discussed above for the rectilinear stroke device are applicable to the rotary stroke device.

It is noted that the rotary stroke device of FIGS. 8 and 9 is operable only in one rotary direction (i.e. clockwise in FIG. 9). A modification of chamber 57, as illustrated in FIG. 10, would permit operation in either rotational direction of the vanes. Specifically, in FIG. 10 a second slot 66' and second lip 60' are provided proximate the upper end of opening 61 to correspond to slot 66 and lip 60 at the lower end. The bore 65' is extended up along one side of chamber 57 to communicate with the upper slot 66'. This configuration results in liquid being forced up to both slots 66 and 66' simultaneously so that the vanes are wetted before entering opening 61, regardless of the rotational direction of the vanes. Actuation may be by thumbwheel or any suitable mechanical arrangement, such as a rack and pinion with spring return, etc.

It should also be noted that the air pumping action effected by all of the embodiments described herein permits a variety of spray effects. For example, if a simple jet of liquid is desired instead of a dispersed spray pattern, such may be achieved by merely providing a suitable passage and nozzle connected to the existing dip tube or a separate dip tube. A valve or the like may be used to block that passage or nozzle when the jet is not described.

The applications for which the present invention is applicable are virtually unlimited. Cleaning fluids, pesticides, anti-perspirants, hair sprays, mouth wash, cologne, coatings, etc. are all suitably sprayed with the device.

While I have described and illustrated one specific embodiment of my invention, it will be clear that variations of the details of construction which are specifically illustrated and described may be resorted to without departing from the true spirit and scope of the invention as defined in the appended claims.

I claim:

1. A liquid spray apparatus of the type in which flexible members are wetted with liquid from a container and then flexed to permit the members to snap back to their unflexed position and, in so doing, throw off a spray pattern of liquid droplets, said apparatus being characterized by:

a chamber having at least one opening;

a movable actuator located in said chamber and having said flexible members secured thereto, said actuator being movable along a path which carries at least a portion of a plurality of said flexible members through said chamber opening;

feed means responsive to movement of said flexible members in said chamber by said actuator for pressurizing said container by means of said flexible members to force liquid from said container into said chamber to wet said flexible members; and a projection disposed proximate said chamber opening in the path of the flexible members being carried through said chamber opening by said actuator such that said projection forces the flexible members passing thereby to flex and then, upon clearing the projection, snap back to their unflexed condition to throw off any liquid with which the flexible members are wetted.

2. A liquid spray apparatus of the type in which flexible members are wetted with liquid from a container and then flexed to permit the members to snap back to their unflexed position and, in so doing, throw off a spray pattern of liquid droplets, said apparatus being characterized by:

a chamber having at least one opening;

a movable actuator located in said chamber and having said flexible members secured thereto, said actuator being movable along a path which carries at least a portion of a plurality of said flexible members through said chamber opening;

feed means responsive to movement of said flexible members in said chamber by said actuator for forcing liquid from said container by means of said flexible members into said chamber to wet said flexible members; and a projection disposed proximate said chamber opening in the path of the flexible members being carried through said chamber opening by said actuator such that said projection forces the flexible members passing thereby to flex and then, upon clearing the projection, snap back to their unflexed condition to throw off any liquid with which the flexible members are wetted;

wherein said feed means comprises:

an air passage communicating between said chamber and said container; and a liquid passage communicating between said chamber and said container;

wherein at least one of said flexible members is sized to be flexed slightly inside said chamber when moving toward said air passage so that said at least one flexible member forces air out of said chamber through said air passage and into said container to force liquid from said container through said liquid passage and into said chamber.

3. The apparatus according to claim 2 wherein:

said chamber is an elongated hollow body having said chamber opening at one end thereof;

said movable actuator is a rod which is movable longitudinally in said hollow body and has said flexible members projecting radially therefrom; and said projection is a lip projecting radially inward proximate said one end of said hollow body.

4. The apparatus according to claim 3 wherein said hollow body is a cylinder.

5. The apparatus according to claim 4 wherein said rod is disposed for movement along the longitudinal axis of said cylinder, wherein said flexible members are a series of longitudinally spaced solid annular vanes extending radially from said rod, and wherein lip is an annular edge of diameter less than the diameter of said vanes.

6. The apparatus according to claim 5 wherein said air passage communicates with said chamber at the end remote from said chamber opening, and wherein said at least one of said flexible members is the closest of said series of vanes to said remote end and has a diameter slightly larger than the diameter of said cylinder at said remote end, whereby movement of said closest vane toward said remote end compresses air trapped between that vane and the remote end so as to force the compressed air through said air passage.

7. The apparatus according to claim 6 further comprising:

bias means for urging said rod in a direction toward said remote end; and hand-operable means for applying a force to oppose said bias means and move said rod through said chamber opening.

8. The apparatus according to claim 7 wherein said hand-operable means comprises a pusher member projecting from said remote end of said cylinder and secured to said cylinder in longitudinally extensible and retractable relation, and wherein said bias means comprises a spring connected to urge said cylinder and pusher member toward their most extended position.

9. The apparatus according to claim 8 wherein, in said most extended position, one of said vanes is positioned in flexed condition to abut and seal said chamber opening.

10. The apparatus according to claim 2 further comprising bias means for urging said actuator in a direction to position at least most of said flexible members inside said chamber, wherein said direction corresponds to movement of said at least one of said flexible members toward said air passage.

11. The apparatus according to claim 2 wherein:

said chamber has a generally flat truncated cylindrical configuration having said chamber opening in the form of a cut out segment of its circumference;

said actuator is a rod which is pivotably mounted along the longitudinal axis of said truncated cylinder for rotation thereabout and has said flexible members projecting radially therefrom to rotate about said axis with said rod; and said projection is a lip projecting inwardly of said chamber proximate said chamber opening to deflect said flexible members as they are rotated past said lip.

12. The apparatus according to claim 11 wherein said flexible members comprise a series of vanes extending like paddle wheels from said rod to a radius slightly larger than that of said truncated cylindrical chamber, and wherein said air passage communicates with a truncated portion of said chamber in which the radius is considerably shorter than said vanes such that said vanes, when rotating, flex and compress air in front of them in the truncated portion and thereby force the compressed air into said air passage.

13. A liquid spray apparatus of the type in which flexible members are wetted with liquid from a container and then flexed to permit the members to snap back to their unflexed position and, in so doing, throw off a spray pattern of liquid droplets, said apparatus being characterized by:

a chamber having at least one opening;

a movable actuator located in said chamber and having said flexible members secured thereto, said actuator being movable along a path which carries at least a portion of a plurality of said flexible members through said chamber opening;

feed means responsive to movement of said flexible members in said chamber by said actuator for forcing liquid from said container by means of said flexible members into said chamber to wet said flexible members; and a projection disposed proximate said chamber opening in the path of the flexible members being carried through said chamber opening by said actuator such that said projection forces the flexible members passing thereby to flex and then, upon clearing the projection, snap back to their unflexed condition to throw off any liquid with which the flexible members are wetted;

wherein:

said chamber is an elongated hollow body having said chamber opening at one end thereof;

said movable actuator is a rod which is movable longitudinally in said hollow body and has said flexible members projecting radially therefrom; and said projection is a lip projecting radially inward proximate said one end of said hollow body.

14. The apparatus according to claim 13 wherein said hollow body is a cylinder.

15. The apparatus according to claim 14 wherein said rod is disposed for movement along the longitudinal axis of said cylinder, wherein said flexible members are a series of longitudinally spaced solid annular vanes extending radially from said rod, and wherein lip is an annular edge of diameter less than the diameter of said vanes.

16. The apparatus according to claim 15 wherein each of said vanes is tapered in thickness such that it is thicker proximate said rod than at its outer edge.

17. The apparatus according to claim 15 wherein at least the vanes nearest said chamber opening are tapered in size such that the smallest vane is at the end of the rod proximate the open chamber end.

18. The apparatus according to claim 17 wherein said smallest vane is larger than said chamber opening and is positionable in abutting relation with said projection to block said chamber opening.

19. A method of spraying liquid from a container with a series of deflectable members which are movable along a predetermined path disposed entirely above said container; said method comprising the steps of:

in response to movement of said deflectable members along a first part of said path, pressurizing said container by means of said deflectable members to force liquid therefrom into said path to wet said deflectable members; and in response to movement of said deflectable members along a second part of said path, deflecting the wetted deflectable members such that they snap back to an undeflected position while throwing off said liquid in a spray pattern.

* * * * *